US006381843B1

(12) United States Patent
Irie et al.

(10) Patent No.: US 6,381,843 B1
(45) Date of Patent: May 7, 2002

(54) METHOD OF PRODUCING A CATALYTIC CONVERTER

(75) Inventors: Tohru Irie, Nagoya; Masashi Ota, Kariya, both of (JP)

(73) Assignee: Sango Co., Ltd., Nagoya (JP)

( * ) Notice: Subject to any disclaimer, the term of this patent is extended or adjusted under 35 U.S.C. 154(b) by 0 days.

(21) Appl. No.: 09/629,164

(22) Filed: Jul. 31, 2000

(30) Foreign Application Priority Data

Aug. 3, 1999 (JP) ..... 11-220540

(51) Int. Cl.[7] ..... F01N 3/28

(52) U.S. Cl. ..... 29/890; 29/515; 29/516; 72/84

(58) Field of Search ..... 29/890, 505, 508, 29/510, 511, 515, 517, 518, 506, 516; 72/84, 85, 112

(56) References Cited

U.S. PATENT DOCUMENTS

| | | | | | |
|---|---|---|---|---|---|
| 2,882,851 | A | * | 4/1959 | Graves | |
| 3,689,111 | A | * | 9/1972 | Osmun et al. | 29/516 |
| 3,792,603 | A | * | 2/1974 | Orain | 29/517 |
| 4,969,264 | A | * | 11/1990 | Dryer et al. | 29/890 |
| 5,104,627 | A | * | 4/1992 | Usui et al. | 29/890 |
| 5,329,698 | A | | 7/1994 | Abbott | 29/890 |
| 5,937,516 | A | * | 8/1999 | De Dousa et al. | 29/890 |
| 5,953,817 | A | * | 9/1999 | Watanabe et al. | 29/890 |
| 5,980,837 | A | * | 11/1999 | Umin et al. | |

FOREIGN PATENT DOCUMENTS

| | | | | |
|---|---|---|---|---|
| JP | 58-084619 | * | 5/1983 | 72/84 |
| JP | 59-092123 | * | 5/1984 | 72/85 |
| JP | A 61-110823 | | 7/1986 | |
| JP | A 64-60711 | | 3/1989 | |
| JP | A 3-146232 | | 6/1991 | |
| JP | A 9-112259 | | 4/1997 | |
| JP | A 9-170424 | | 6/1997 | |
| JP | A 9-234377 | | 9/1997 | |
| JP | A 11-147138 | | 6/1999 | |
| JP | A 11-151535 | | 6/1999 | |
| JP | 11-336537 | * | 12/1999 | |
| JP | A 2000-045762 | | 2/2000 | |

* cited by examiner

*Primary Examiner*—P. W. Echols
*Assistant Examiner*—Eric Compton
(74) *Attorney, Agent, or Firm*—Oliff & Berridge, PLC

(57) ABSTRACT

A method of producing a catalytic converter comprises the steps of (1) providing a shock absorbent member around an outer periphery of a catalyst substrate, (2) inserting the catalyst substrate and the shock absorbent member into a cylindrical workpiece, fixing the cylindrical workpiece to prevent the cylindrical workpiece from being rotated about a longitudinal axis thereof, and (3) spinning at least a portion of the cylindrical workpiece covering at least a portion of the shock absorbent member, by means of a plurality of spinning rollers, which are evenly positioned around the outer periphery of the cylindrical workpiece, and which are revolved about the axis of the cylindrical workpiece along a common circular locus, and moved in a radial direction of the cylindrical workpiece, whereby the cylindrical workpiece and the shock absorbent member are reduced in diameter, so that the catalyst substrate is securely held in the cylindrical workpiece.

13 Claims, 7 Drawing Sheets

METHOD OF PRODUCING A CATALYTIC CONVERTER

BACKGROUND OF THE INVENTION

1. Field of the Invention

The present invention relates to a method of producing a catalytic converter, particularly the method of producing the catalytic converter with a catalyst substrate held in a cylindrical housing through a shock absorbent member.

2. Description of the Related Arts

In order to produce catalytic converters mounted on recent vehicles, generally employed is such a method for rolling a ceramic mat around a catalyst substrate to form a shock absorbent member, and pressing the shock absorbent mat into a casing, or cylindrical housing. On one hand, the shock absorbent mat is required to be made thick and soft to provide its shock absorbing function, on the other hand, the shock absorbent mat is required to be made thin and hard to press it into the casing easily. In order to meet those requirements contradictory to each other, the shock absorbent mat has to be made to reach a compromise between them.

According to the prior method, therefore, it has been pointed out that the catalyst substrate could not be protected by the shock absorbent mat sufficiently, to deteriorate the substrate, or that the catalyst substrate and the shock absorbent mat were damaged when they were pressed into the casing. In order to solve those problems, it has been proposed that after the catalyst substrate and the shock absorbent mat were inserted into the cylindrical housing, the housing is compressed so as to compress the shock absorbent mat by a certain amount, as disclosed in publications such as U.S. Pat. No. 5,329,698, Japanese Patent Laid-open Publication Nos. 64-60711, 9-234377, 9-170424 and so on.

With respect to the cylindrical housing for holding the catalyst substrate therein, it has been proposed in Japanese Utility-model Laid-open Publication No. 61-110823 that in order to overcome inconvenience in a prior method for welding a casing body with cone portions at its opposite ends, a tubular member or pipe is increased or decreased in diameter to form the casing body and at least one of the cone portions in a body, thereby to produce a case for holding the catalyst substrate. In this Publication, it is disclosed that one end portion of the tubular member having the same diameter with that of the casing body is reduced in diameter to form a cone portion and a guide pipe integrally, and the catalyst substrate and cushion member are inserted into a cylindrical portion of the casing body, and then an open end portion of the case except for the casing body is reduced in diameter by a spinning process to integrate it with the other cone portion and the guide pipe. However, the Publication is silent about the spinning process, nor a possibility for applying the spinning process to the casing body.

Also, Japanese Patent Laid-open Publication No. 9-112259 discloses a prior method of producing a monolithic catalyst converter by welding flanges of an upper member and a lower member, with a monolithic catalyst held between the upper member and lower member, and another prior method for welding a cylindrical portion with cone portions at its opposite ends. In order to overcome inconvenience in assembling parts according to the prior methods, the Publication proposes such a method of producing a monolithic catalyst converter that has an inserting process for inserting the monolithic catalyst into a cylindrical pipe member, and a drawing process for drawing opposite open ends of the pipe member to form them into a funnel shape respectively. It is disclosed in the publication that the drawing process is performed by a drawing apparatus with dies, or a spinning drawing apparatus, which is shown in FIG. 9 of the Publication, and which is explained that a roller is pressed onto one opening end of the pipe member, with the pipe member being rotated about its axis. In FIG. 5 of the Publication, there is disclosed such a method that after the process for inserting the monolithic catalyst and the drawing process were performed, a pressing jig having rollers is pressed onto the pipe member to form ring-shaped recesses on its cylindrical portion.

In the methods of producing the catalytic converters as disclosed in the above-described Japanese Publication Nos. 61-110823 and 9-112259, the drawing process is performed by the spinning process, which has not been explained practically in the Publication No. 61-110823, but which has been disclosed in FIG. 9 of the Publication No. 9-112259. That is, it is apparent from the Publication No. 9-112259 that the spinning process is a known process, in which a single roller is pressed onto one opening end of the pipe member, with the pipe member being rotated about its axis, and which had been generally used as an embodiment of the drawing process. Otherwise, any process different from the general process should have been explained in the Publications. For example, Japanese Patent Laid-open Publication No. 3-146232, which relates to a technical field entirely different from the catalytic converter, discloses a method for processing an end portion of a tubular member having grooves formed therein, wherein a forming roll is pressed onto an end portion of a grooved pipe material formed inside surface thereof with grooves in the longitudinal direction, and rotated by a rotating mechanism, and the end portion of the tubular member is drawn to be decreased in diameter, with the forming roll revolved and freely rotated in accordance with rotation of the rotating mechanism, and moved in a radial direction. In that method, the single forming roll has been employed, as in the prior method.

According to the method for holding the catalyst substrate in the cylindrical housing through the shock absorbent member as disclosed in the aforementioned Publication, the compressing process by means of the die, or the compressing process by means of the pressing jig has been employed, so that the workpiece of the cylindrical housing is formed only by the compressing force in the circumferential direction or radial direction. Therefore, the material of the workpiece will be hardly moved in the circumferential direction and radial direction, to cause a buckling of the workpiece, or an uneven wall thickness of the cylindrical housing, which will possibly result in uneven compressed amount of the shock absorbent mat, and consequently uneven force for holding the catalyst substrate. Thus, the prior method can not be the best method. While it may not cause the buckling of the workpiece, nor uneven wall thickness of the cylindrical housing, it is very difficult for the prior method to obtain a circularity of the cylindrical housing, and provide evenly compressed amount of the shock absorbent mat around the whole circumference. In view of those circumstances, such a method as compressing the shock absorbent mat evenly and accurately in its longitudinal direction around its whole circumference has been desired.

SUMMARY OF THE INVENTION

Accordingly, it is an object of the present invention to provide a method of producing a catalytic converter with a catalyst substrate held in a cylindrical housing through a shock absorbent member, by reducing the cylindrical housing and shock absorbent member in diameter evenly, to hold the catalyst substrate properly.

In accomplishing the above and other objects, the method of producing the catalytic converter may comprise providing a shock absorbent member around an outer periphery of a catalyst substrate, inserting the catalyst substrate and the shock absorbent member into a cylindrical workpiece, fixing the cylindrical workpiece to prevent the cylindrical workpiece from being rotated about a longitudinal axis thereof, and spinning at least a portion of the cylindrical workpiece covering at least a portion of the shock absorbent member, by means of a plurality of spinning rollers, which are evenly positioned around the outer periphery of the cylindrical workpiece, and which are revolved about the axis of the cylindrical workpiece along a common circular locus, and moved in a radial direction of the cylindrical workpiece, to reduce the cylindrical workpiece and the shock absorbent member in diameter, and hold the catalyst substrate in the cylindrical workpiece.

The method may further comprise measuring an outer diameter of the catalyst substrate and an inner diameter of the cylindrical workpiece, calculating a target amount of the shock absorbent member to be reduced on the basis of the measured diameters, and moving the spinning rollers in the radial direction of the cylindrical workpiece by the target amount to be reduced.

The method may further comprise reducing the diameter of the portion of the cylindrical workpiece covering the portion of the shock absorbent member by the spinning rollers, and simultaneously applying a necking process to at least one end portion of the cylindrical workpiece by the spinning rollers, to form a neck portion of the cylindrical workpiece.

The spinning process may be applied to the portion of the cylindrical workpiece covering the portion of the shock absorbent member, with opposite ends of the cylindrical workpiece securely fixed, to reduce the diameter of the cylindrical workpiece together with the shock absorbent member, and hold the catalyst substrate in the cylindrical workpiece.

BRIEF DESCRIPTION OF THE DRAWINGS

The above stated object and following description will become readily apparent with reference to the accompanying drawings, wherein like reference numerals denote like elements, and in which.

DESCRIPTION OF THE PREFERRED EMBODIMENTS

Figure 1:
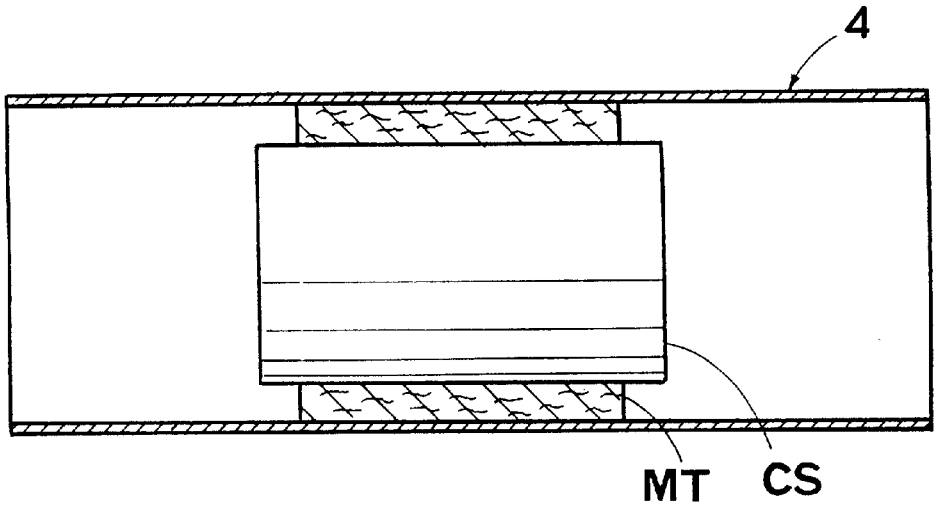
FIG. 1*a* side view sectioned in part of a catalytic converter, with a catalyst substrate and a shock absorbent mat rolled around the substrate, received in a cylindrical housing, in an embodiment of a method of producing a catalytic converter according to the present invention.
Figure 2:
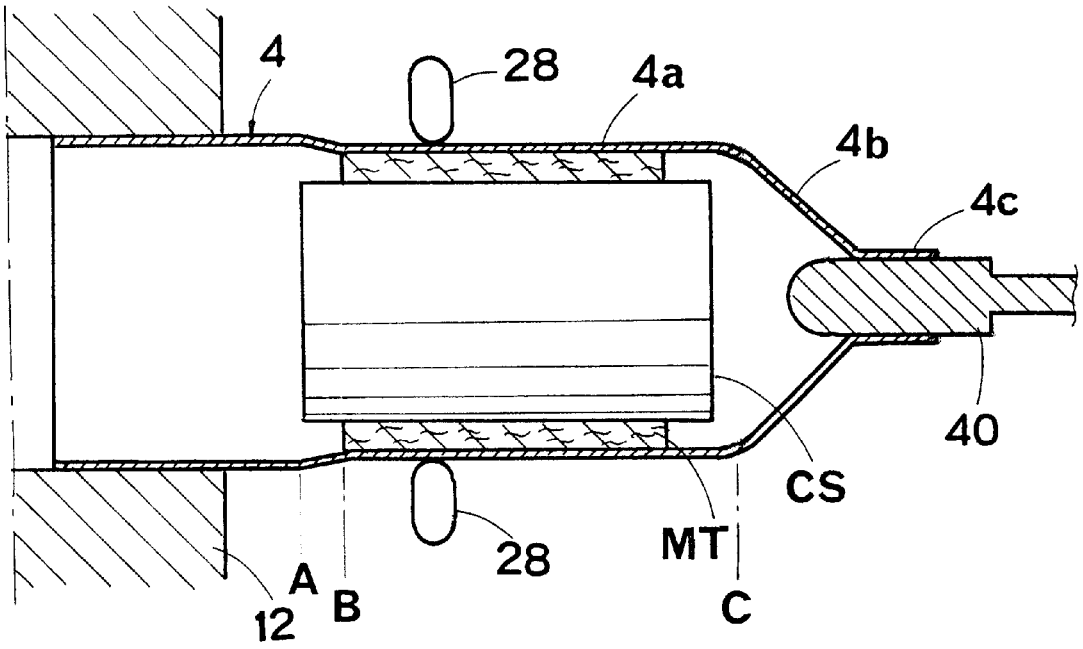
FIG. 2 is a side view sectioned in part of a catalytic converter, with a cylindrical housing applied with a spinning process to reduce a cylindrical housing and a shock absorbent member in diameter, and with one end potion of the cylindrical housing applied with a necking process by means of spinning rollers, in an embodiment of a method of producing a catalytic converter according to the present invention.
Figure 3:
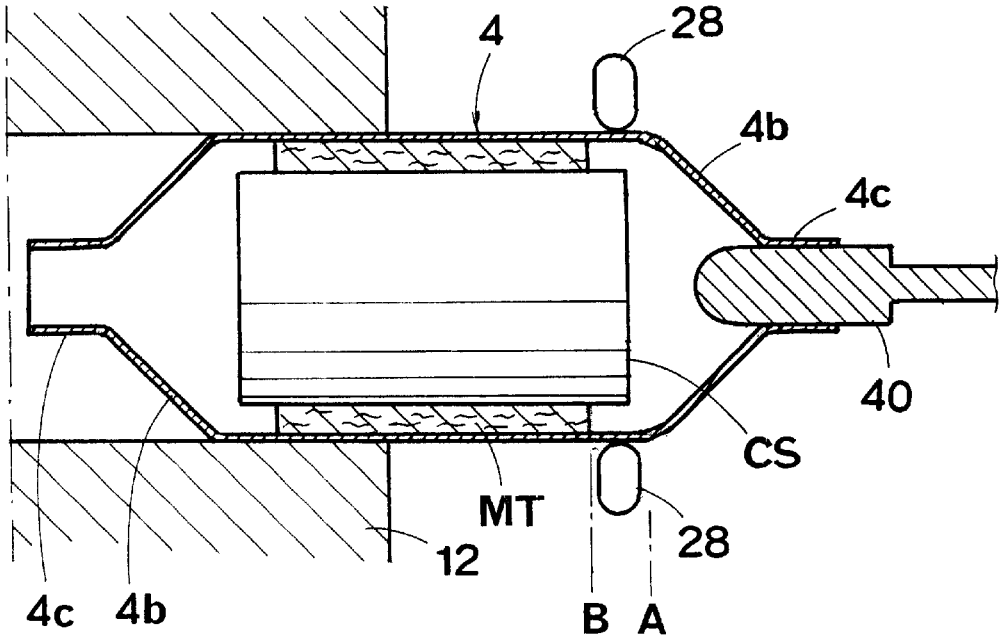
FIG. 3 is a side view sectioned in part of a catalytic converter, with the other one end potion of the cylindrical housing applied with a necking process by means of spinning rollers, in an embodiment of a method of producing a catalytic converter according to the present invention.

Referring to FIGS. 1–3, there is schematically illustrated a cylindrical housing with a catalyst substrate and a shock absorbent member received in a cylindrical housing, in each step for a method of producing a catalytic converter according to an embodiment of the present invention, respectively. At the outset, a shock absorbent mat (MT), which serves as the shock absorbent member of the present invention, is rolled around a catalyst substrate (CS) as shown in FIG. 1, and fixed by an inflammable tape if necessary. Then, these are received in a cylindrical workpiece 4, which will be formed into a cylindrical housing 4 (indicated by the same numeral reference as that of the workpiece). In this case, the outer surface of the shock absorbent mat (MT) is not pressed onto the inner surface of the cylindrical workpiece 4, i.e., the former is not pressed into the latter, but the catalyst substrate (CS) and the shock absorbent mat (MT) are smoothly received in the cylindrical workpiece 4. At this step, therefore, the catalyst substrate (CS) and the shock absorbent mat (MT) are not damaged. According to the present embodiment, the catalyst substrate (CS) is made of ceramics, while it may be made of metal. The cylindrical workpiece 4 is a stainless steel tube, while it may be a tube made of other metals. According to the present embodiment, the shock absorbent mat (MT) is constituted by an alumina mat which will be hardly expanded by heat, but may be employed a vermiculite mat having a thermal expansion property, because any kinds of mats may be employed in the present invention.

Next, as shown in FIG. 2, one end portion of the cylindrical workpiece 4 is clamped by a clamp device 12, which will be described later, to be securely fixed not to be rotated, and not to be moved axially. Then, a spinning process is made to at least a portion of the cylindrical workpiece 4 covering at least a portion of the shock absorbent mat (MT), by means of a plurality of spinning rollers 28, which are revolved about the cylindrical workpiece 4 along a common circular locus, and which will be described later. That is, a plurality of spinning rollers, which are positioned around the outer periphery of the cylindrical workpiece 4, preferably with an equal distance spaced between the neighboring rollers, are pressed onto the outer surface of the cylindrical workpiece 4, and revolved about the central axis thereof, and moved along the axis (to the right in FIG. 2), with a revolutionary locus reduced gradually, to achieve the spinning process. If the compressed amount of the shock absorbent mat (MT) obtained by reducing the diameter of the cylindrical workpiece 4 is required to be 2–4 millimeters, for example, the radius of revolution of each spinning roller 28 may be reduced by 2–4 millimeters.

As shown in FIG. 2, the cylindrical workpiece 4 is gradually reduced in diameter from a position (A) to a position (B) by means of the spinning rollers 28, and formed to provide a constant diameter from the position (B) to a position (C), and then rapidly reduced in diameter from the position (C) to the right in FIG. 2, thorough a necking process by means of the spinning rollers 28. As a result, a reduced diameter portion 4*a* is formed between the position (B) and the position (C), and a tapered portion 4*b* and a bottle neck portion 4*c* are formed from the position (C) to the right in FIG. 2. The diameter reducing process applied to the portion from the position (A) to the position (C), and the necking process applied to the portion from the position (C) to the right in FIG. 2 may be performed separately. However, the consecutive single process as explained above can shorten a tact time, and save an energy supplied to the apparatus, so that it will be efficient. Consequently, the shock absorbent mat (MT) is reduced in diameter together with the cylindrical workpiece 4, so that the catalyst substrate (CS) is held in the cylindrical workpiece 4 in a stable state.

Then, the cylindrical workpiece 4 is reversed by 180 degree, and positioned as shown in FIG. 3, so that the necking process is made by means of the spinning rollers 28, with respect to the other one end portion of the cylindrical workpiece 4, as well. The reversing operation of the cylindrical workpiece 4 is performed after the process as shown in FIG. 2, as follows. That is, the cylindrical workpiece 4 is released from the clamp device 12, and reversed by a robot hand (not shown), and then clamped again by the clamp device 12. The robot may be used for supplying workpieces such as the cylindrical workpiece 4 and transferring the same, to obtain a more efficient productivity. Thereafter, the other one end portion of the cylindrical workpiece 4 is clamped by the clamp device 12, and an unfinished portion of the cylindrical workpiece 4 from the position (B) to the left in FIG. 2 is formed by the spinning rollers 28 to form the tapered portion 4*b* and the bottle neck portion 4*c*. As shown in FIGS. 2 and 3, when the necking process is performed by the spinning rollers 28, with an axially movable mandrel 40, which will be described later, inserted in the open end of the cylindrical workpiece 4, accuracy of shape of the bottle neck portion 4*c* can be improved. Furthermore, at first the necking process may be performed to one end portion of the cylindrical workpiece 4, and then the spinning process may be performed to form the reduced diameter portion 4*a*, and finally the necking process may be performed to the other one end portion of the cylindrical workpiece 4, so that the consecutive forming process by the spinning rollers 28 can be achieved.

Figure 4:
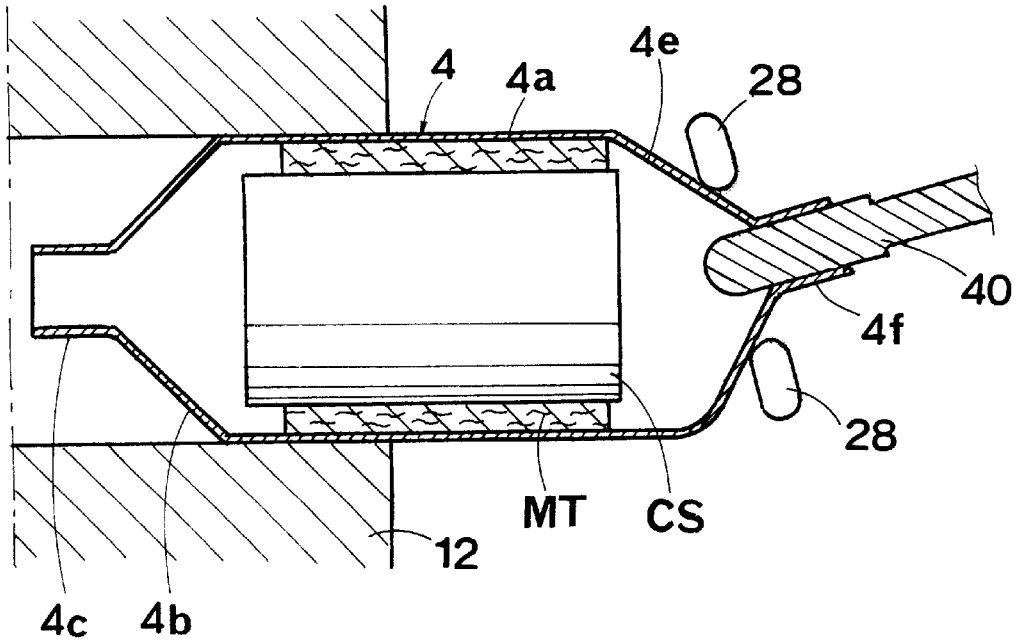
FIG. 4 is a side view sectioned in part of a catalytic converter, with the other one end potion of the cylindrical housing applied with a necking process by means of spinning rollers about an oblique axis, in another embodiment of a method of producing a catalytic converter according to the present invention.

FIG. 4 illustrates another embodiment of the present invention, wherein the process as shown in FIG. 4 is performed instead of the process as shown in FIG. 3, after the processes as shown in FIGS. 1 and 2 were performed. In FIG. 4, the mandrel 40 is positioned in such a manner that its axis is oblique to the axis of the cylindrical workpiece 4, to which the necking process is performed by the spinning rollers 28. Consequently, the tapered portion 4*e* and the bottle neck portion 4*f* having the oblique axis to the axis of the reduced diameter portion 4*a* can be formed. Or, there may be formed the tapered portion 4*e* and the bottle neck portion 4*f* having an offset axis from the axis of the reduced diameter portion 4*a*, while the figure is omitted herein. Furthermore, the necking process to the opposite ends of the cylindrical workpiece 4 can be performed, in accordance with a combination of axes coaxial with, oblique to, and offset from the axis of the reduced diameter portion 4*a*. The spinning processes performed along the offset axis and oblique axis are disclosed in Japanese Patent Laid-open Publication Nos. 11-147138 and 11-151535, and those processes can be used to form the end portion of the cylindrical workpiece 4.

Figure 5:
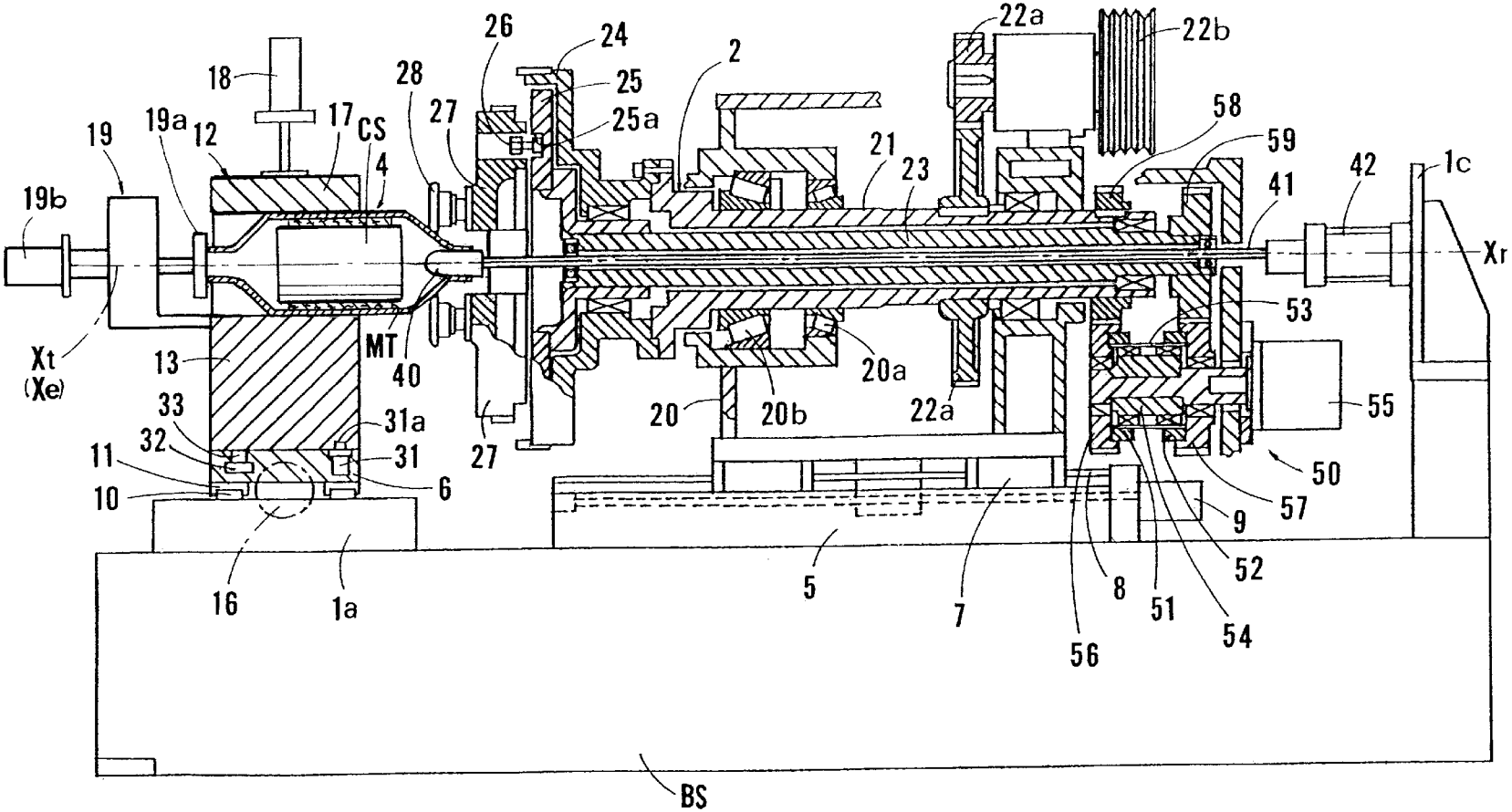
FIG. 5 is a side view of a spinning apparatus with a portion thereof sectioned, for use in an embodiment of a method of producing a catalytic converter according to the present invention.
Figure 6:
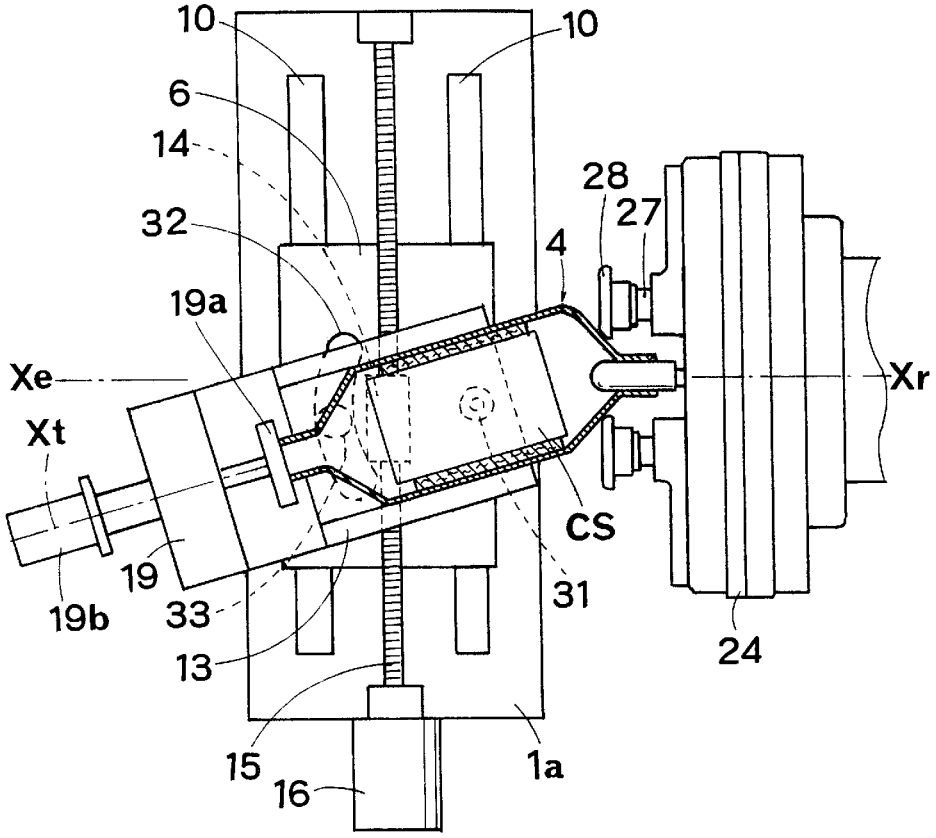
FIG. 6 is a plan view of a part of a spinning apparatus with a portion thereof sectioned, for use in an embodiment of a method of producing a catalytic converter according to the present invention.
Figure 7:
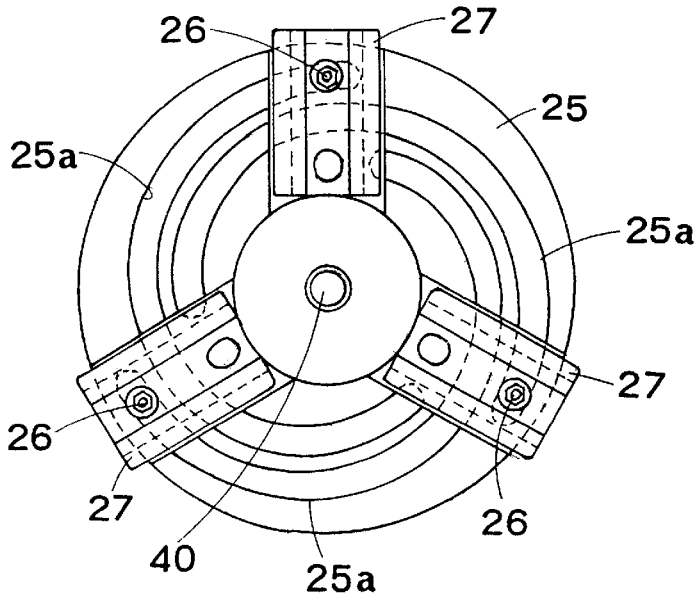
FIG. 7 is a front view showing a cam plate and support members of a spinning apparatus for use in an embodiment of a method of producing a catalytic converter according to the present invention.

In FIGS. 5–7, there is shown the spinning apparatus for use in producing the catalytic converters as described above. Among them, FIG. 6 shows the apparatus for performing the necking process as shown in FIG. 4. In FIGS. 5 and 6, a forming target central axis Xe of one end portion of the cylindrical workpiece 4 is employed as a X-axis of the apparatus, while the forming target central axis Xe of the cylindrical workpiece 4 is aligned with the central axis Xt, because they are on the same plane in FIG. 5. In parallel with the X-axis, a pair of X-axis guide rails 5 are secured to one side (right side in FIG. 5) on a base BS. A case 20 is arranged to be movable along the X-axis guide rails 5. The case 20 has a ball socket 7 which is secured under the case 20, and which is engaged with a spline shaft 8. This shaft 8 is mounted on the base BS in parallel with the X-axis guide rails 5, to be rotated by a servo motor 9. Accordingly, when the spline shaft 8 is rotated by the servo motor 9, the case 20 is moved along the X-axis. On the other hand, a bed 1*a* is formed on the other side (left side in FIG. 5) of the base BS. Secured to the bed 1*a* are a pair of Y-axis guide rails 10, on which a pair of sliders 11 for supporting a sliding table 6 are movably mounted, and a clamp device 12 is mounted on the table 6. The clamp device 12 includes a lower clamp 13 rotatably mounted on the table 6, and an upper clamp 17 arranged upward of the lower clamp 13, to clamp the cylindrical workpiece 4 between the lower clamp 13 and upper clamp 17. The table 6 has a ball socket 14 (as shown in FIG. 6) secured thereunder, which is engaged with a spline shaft 15. This shaft 15 is mounted on the bed 1*a* in parallel with the Y-axis guide rails 10, to be rotated by a servo motor 16. When the spline shaft 15 is rotated by the motor 16, the table 6 and clamp device 12 are moved along the Y-axis.

Above the clamp device 17, an actuator 18, which is activated by oil pressure, for example, is arranged to support the upper clamp 17 and drive it vertically. When the cylindrical workpiece 4 is set on or removed from the clamp device 12, the upper clamp 17 is lifted by the actuator 18 upward. A clamp face of a half cylinder configuration is formed on the upper surface of the lower clamp 13, and a clamp face of a half cylinder configuration is formed on the lower surface of the upper clamp 17. Therefore, when the cylindrical workpiece 4 is clamped between the clamp faces, it is secured not to be rotated or moved. On the clamp device 12, a positioning device 19 is disposed at the opposite side to the case 20, so that the cylindrical workpiece 4 is positioned so as to abut on a stopper 19*a* of the positioning device 19. The positioning device 19 is secured to the lower clamp 13, so as to be moved together with the clamp device 12. The stopper 19*a* of the positioning device 19 is supported by a cylinder 19*b* to be moved in the axial direction, so that the stopper 19*a* can be positioned along the X-axis relative to the lower clamp 13. Therefore, positioning of the cylindrical workpiece 4 along its longitudinal axis can be made properly and easily, in the processes as shown in FIGS. 2 and 3.

Accordingly, when the cylindrical workpiece 4 is set on the clamp face of the lower clamp 13, with the one end portion of the cylindrical workpiece 4 abutted on the stopper 19*a*, and then the upper clamp 17 is actuated to move downward by the actuator 18, the cylindrical workpiece 4 is clamped at a predetermined position between the lower clamp 13 and upper clamp 17. In this case, the cylindrical workpiece 4 is positioned such that its central axis Xt is located on the same plane as the plane where the longitudinal central axis Xr of a main shaft 21, which will be described later, is located in parallel with the base BS, i.e., on the same height from the base BS as the height of the central axis Xr from the base BS.

A rotating device such as a motor 31 is embedded in the table 6 at the left side in FIG. 5, and an output shaft 31*a* of the motor 31 extends upward in FIG. 1, or vertically to the base 5, to be engaged with the lower clamp 13, which is rotated about the shaft 31*a*. On the upper surface of the table 6, there is formed a guide groove 32 which has a circular configuration with its center located on the shaft 31*a*, and into which a guide roller 33 is fitted. The guide roller 33 is rotatably mounted on the lower clamp 13, so that the lower clamp 13 is guided by the groove 32 to be rotated about the shaft 31*a*. FIG. 6 illustrates such a state that the lower clamp 13 is rotated by a predetermined angle.

In the right section of FIG. 5, the main shaft 21 is positioned on the same plane as the plane, on which the central axis Xt of the cylindrical workpiece 4 is located, and which is parallel with the base BS. The main shaft 21 is placed on approximately the same axis as the forming target central axis Xe of the cylindrical workpiece 4 to be opposite to the cylindrical workpiece 4, and mounted on the case 20 through bearings 20*a*, 20*b* to be rotated about the central axis Xr. The main shaft 21 is a hollow cylindrical member, in which a cylindrical cam shaft 23 is received, and which is connected to a changing speed mechanism 50 as described later. Through a hollow portion of the cam shaft 23, a connecting rod 41 of the mandrel 40 is mounted to be movable in the axial direction of the cam shaft 23, independently from the main shaft 2. The mandrel 40 is formed to be fitted into the inner shape of the open end portion of the cylindrical workpiece 4. The connecting rod 41 is connected at its end to a cylinder 42 for driving it to move back and forth, and the cylinder 42 is mounted on the base BS through a bracket 1*c*. The main shaft 21 is connected through a gear train 22*a* to a pulley 22*b*, which is further connected to a rotating device such as a motor (not shown) through a belt (not shown), so as to rotate the main shaft 21. A flange 24 is fixed to a tip end of the main shaft 21, so that the flange 24 is rotated about the central axis Xr, together with the main shaft 21, when the latter is rotated. The cam shaft 23 is rotatably mounted on the flange 24. A cam plate 25 is fixed to a tip end portion of the cam shaft 23, and rotated about the central axis Xr together with the cam shaft 23. As shown in FIG. 7, the cam plate 25 is formed with three spiral guide grooves 25*a*, in which three guide pins 26 are disposed, respectively, to be moved in a radial direction in accordance with rotation of the cam plate 25. The guide pins 26 are mounted on three support members 27, respectively, and the roller 28 is rotatably mounted on each support member 27, as shown in FIG. 5. When the main shaft 21 is rotated, therefore, the roller 28 is revolved about the central axis Xr, and at the same time the support members 27 are moved in a radial direction along the guide grooves 25*a* in accordance with rotation of the cam plate 25, so that the roller 28 is moved toward and away from the central axis Xr of the cylindrical workpiece 4. That is, the spinning rollers 28 are activated while the cam plate 25 is being rotated, and they are revolved about the central axis Xr of the cylindrical workpiece 4, with the diameter of the revolutional locus changed.

The speed changing mechanism 50 connected to the main shaft 21 and the cam shaft 23 is the one employing a flexibly engaged driving system that includes a pair of outer rings 51, 52, which are engaged with the main shaft 21 and the cam shaft 23, respectively, and inner surfaces of which are formed with gears of the same number of teeth. The flexibly engaged driving system further includes a flexible gear wheel 53, which is formed with different number of teeth from the gears of the outer rings 51, 52, and which is engaged with the outer rings 51, 52, and includes a wave forming wheel 54, which is arranged to support the gear wheel 53 to be rotated, and which is arranged to engage with the gears of the outer rings 51, 52 at the two positions facing each other. The wave forming wheel 54 is rotated by a decelerating motor 55. The outer rings 51, 52 are mounted on support gears 56, 57, respectively. A driving gear 58 engaged with the support gear 56 is mounted on the main shaft 21, and a driven gear 59 engaged with the support gear 57 is mounted on the cam shaft 23. The flexibly engaged driving system is already known as a Harmonic Drive (TM of Harmonic Drive Systems, Inc.), for example, and an explanation of its principle will be omitted. The system in the present embodiment provides a differential mechanism which causes a relative speed difference between the outer rings 51 and 52 in accordance with rotation of the main shaft 21. Accordingly, when the main shaft 21 is rotated, the cam shaft 23 is rotated by the differential rotation between the outer rings 51, 52, thereby to rotate the cam plate 25, so that each support member 27 and each roller 28 together therewith are moved in a radial direction toward and away from the central axis Xr of the main shaft 21. A plurality of rollers 28 are provided so as to reduce intermittent impacts, and it is ideal to provide three rollers 28 positioned with an equal distance spaced between the neighboring rollers, as in the present embodiment. Any course may be traced by the rollers 28 as long as the rollers 28 can be moved in a radial direction. As a further embodiment of the device for driving the rollers 28, may be employed a planetary gear mechanism (not shown herein), or other devices. The motors 9, 16, 31, 55 or the like and the actuators 18, 19*b*, 42 or the like are electrically connected to a controller (not shown), from which control signals are output to the motors and actuators to control them numerically.

In operation, referring to FIG. 5, when the upper clamp 17 of the clamp device 12 is lifted upward, the cylindrical workpiece 4 to be formed is placed on the clamp face of the lower clamp 13, and set at the predetermined position where the one end portion of the cylindrical workpiece 4 is abutted on the stopper 19*a* of the positioning device 19. Then, the actuator 18 is driven, so that the upper clamp 17 is moved downward, and the cylindrical workpiece 4 is clamped between the lower clamp 13 and upper clamp 17, and held not to be rotated. In this case, the cylindrical workpiece 4 is positioned such that the central axis Xt of the cylindrical workpiece 4 is aligned with the central axis Xr of the main shaft 21, to be placed in a different state from that as shown in FIG. 6. Each roller 28 is retracted outside of the outer periphery of the cylindrical workpiece 4. Next, the case 20 is moved forward along the X-axis guide rail 5, i.e., leftward in FIGS. 5 and 6, and stopped at a position where each roller 28 is placed at the position away from the center of the shaft 31*a* of the clamp device 12 by a predetermined distance. Then, the mandrel 40 is moved forward to be placed in the open end portion of the cylindrical workpiece 4.

From the state as described above, the main shaft 21 is rotated about the central axis Xr, and each roller 28 is revolved about the central axis Xr, and the cam plate 25 is rotated through the speed changing mechanism 50, so that each roller 28 is moved radially toward the central axis Xr. At the same time, each roller 28 is moved rearward (rightward in FIGS. 5 and 6) along the X-axis guide rail 5. Accordingly, each roller 28 is rotated on its axis and revolved about the central axis Xr, in such a state pressed onto the outer surface of the end portion of the cylindrical workpiece 4, and moved radially toward the central axis Xr to perform the spinning process. Likewise, a plurality number of forming cycles are executed to form the reduced diameter portion 4*a*. Furthermore, the opposite ends of the cylindrical workpiece 4 are formed by the spinning rollers 28 through the necking process, to provide the finished configuration of the tapered portion 4*b* and the bottle neck portion 4*c* as shown in FIG. 2.

According to the present embodiment, the pressing force is always applied to the cylindrical workpiece 4 toward the axis thereof, by means of a plurality of spinning rollers 28 revolved about the axis of the cylindrical workpiece 4, along a common circular locus, with an equal distance spaced between the neighboring rollers. Therefore, the spinning process is applied to the cylindrical workpiece 4, with an equal and smooth plastic flow ensured in a circumferential direction. Furthermore, the pressing force applied by each one of the rollers 28 toward the axis of the cylindrical workpiece 4 is balanced with the pressing force applied by the other rollers about the axis, so that the cylindrical workpiece 4 will not be inclined, nor the rollers 28 will be moved away from the cylindrical workpiece 4. As a result, the pressing force applied by the spinning rollers 28 to the cylindrical workpiece can be transformed into the plastic flow without loss, efficiently. In addition, since both of the cylindrical workpiece 4 and connecting rod 41 are not to be rotated, it is easy to provide a structure for strongly pressing the cylindrical workpiece 4, and any deficiencies such as vibration of the cylindrical workpiece 4 caused by the rotation thereof can be avoided. According to the present embodiment, the necking process to the opposite ends of the cylindrical workpiece 4 can be made by a single consecutive process, so that the working time can be reduced largely, comparing with the prior process. Also, the reversing operation of the cylindrical workpiece 4 can be made easily without stopping the rotation of the spinning rollers 28, so that the tact time can be reduced, and energy efficiency will be improved.

The spinning process as described above can be automated in accordance with the steps as follows:

At the outset, a target thickness (T) of the shock absorbent mat (MT) is stored in a memory of a computer (not shown). Then, the outer diameter (D1) of the catalyst substrate (CS) and the inner diameter (D2) of the cylindrical workpiece 4 are measured, and stored in the memory. On the basis of those measured data, a clearance (C) between the outer surface of the catalyst substrate (CS) and the inner surface of the cylindrical workpiece 4 is calculated by the computer. That is, the clearance (C) is obtained from C=(D1−D2)/b 2. When the target thickness (T) of the shock absorbent mat (MT) is subtracted from the clearance (C), a half of the diameter of the cylindrical workpiece 4 to be reduced is obtained to provide a value (P) (i.e., P=C−T). The value (P) is set as a target diameter to be reduced (S), and each of the spinning rollers 28 is moved in a radial direction (i.e., the radius of revolution of the rollers 28 about the axis is reduced) by the target diameter to be reduced (S) from a reference position where the rollers 28 abutted on the outer surface of the cylindrical workpiece 4. Consequently, the shock absorbent mat (MT) can be compressed until the shock absorbent mat (MT) will be reduced in diameter to reach the target thickness (T) accurately, irrelevant of scales of the catalyst substrate (CS) and the cylindrical workpiece 4. Therefore, the cylindrical workpiece 4 is evenly reduced in diameter with a stable accuracy, and the shock absorbent mat (MT) is evenly reduced in diameter, as well. As for a measuring method of the inner diameter (D2) of the cylindrical workpiece 4, the inner diameter (D2) can be obtained from such a calculation that the outer diameter of the cylindrical workpiece 4 is measured directly by a measuring device (not shown), and then the thickness of the cylindrical workpiece 4 is subtracted from the measured outer diameter. Furthermore, a circularity of the cylindrical workpiece 4 or that of the catalyst substrate (CS) may be measured and added to the compressed amount around each circumference. With respect to the measuring device, a general sensor of contact type, or a sensor of non-contact type such as a laser sensor may be used. The sensor may be moved by a robot to make such measurement as described above efficiently, and the robot for supplying and transferring the cylindrical workpiece 4 may be used. The computer as described above may be provided independently, or the computer for the spinning process may be used.

Figure 8:
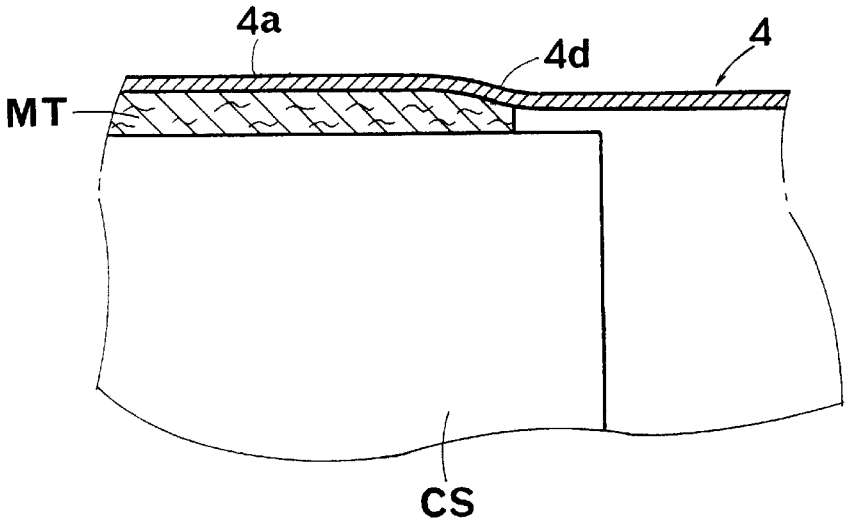
FIG. 8 is a side view sectioned in part of a catalytic converter, with a cylindrical housing applied with a spinning process to reduce a cylindrical housing and a shock absorbent member in diameter, and with one end potion of the cylindrical housing applied with a necking process by means of spinning rollers, in a further embodiment of a method of producing a catalytic converter according to the present invention.

FIG. 8 illustrates an embodiment wherein the reduced amount in diameter of the cylindrical workpiece 4 is made larger in the vicinity of end portions of the shock absorbent mat (MT), to prevent the catalyst substrate (CS) from being moved axially in the cylindrical workpiece 4. As a result, a stepped portion 4*d* is formed on the cylindrical workpiece 4, as shown in FIG. 8. In practice, by changing the radius of revolution of the spinning rollers 28, the cylindrical workpiece 4 can be easily formed as shown in FIG. 8, so that the reduced amount in diameter can be made larger in the vicinity of the end portions of the shock absorbent mat (MT). The stepped portion 4*d* may be formed in the vicinity of opposite end portions or only one end portion of the shock absorbent mat (MT). Thus, by controlling the spinning rollers 28 as desired, the cylindrical workpiece 4 may be formed in a desired shape.

In the above-described embodiments, only one end portion of the cylindrical workpiece 4 is clamped by the clamp device 12. In the case where the cylindrical workpiece 4 to be formed is short in length, however, it is difficult to perform the spinning process to the cylindrical workpiece 4. Even in that case, the spinning process can be performed easily by an embodiment as explained hereinafter with reference to FIGS. 1 and 9–12.

Figure 9:
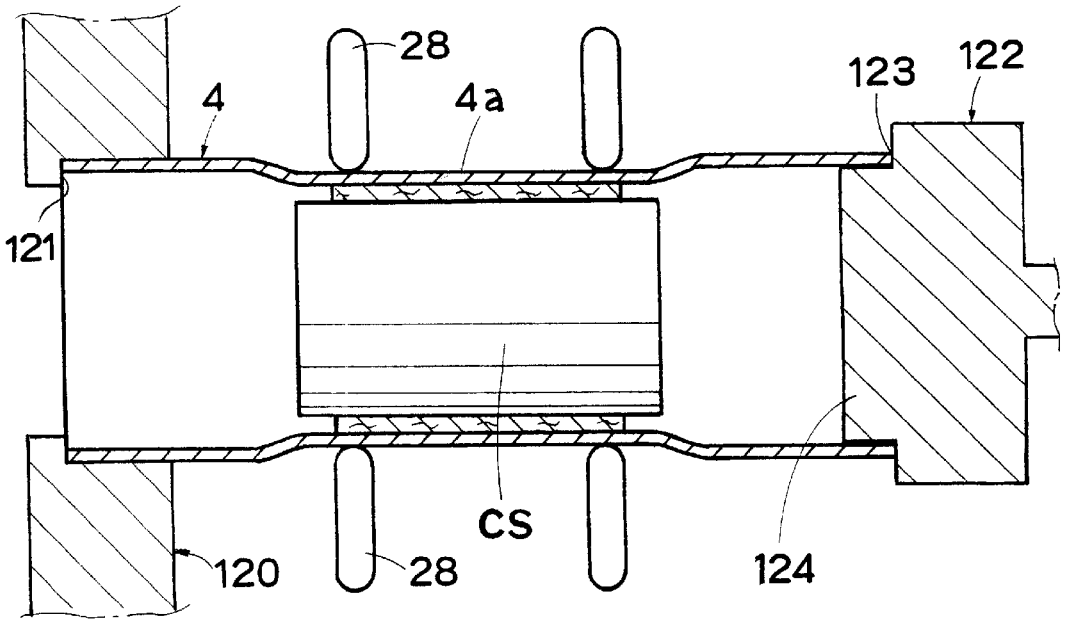
FIG. 9 is a side view sectioned in part of a catalytic converter, with a cylindrical housing applied with a spinning process to reduce a cylindrical housing and a shock absorbent member in diameter, and with one end potion of the cylindrical housing applied with a necking process by means of spinning rollers, in a further embodiment of a method of producing a catalytic converter according to the present invention.
Figure 10:
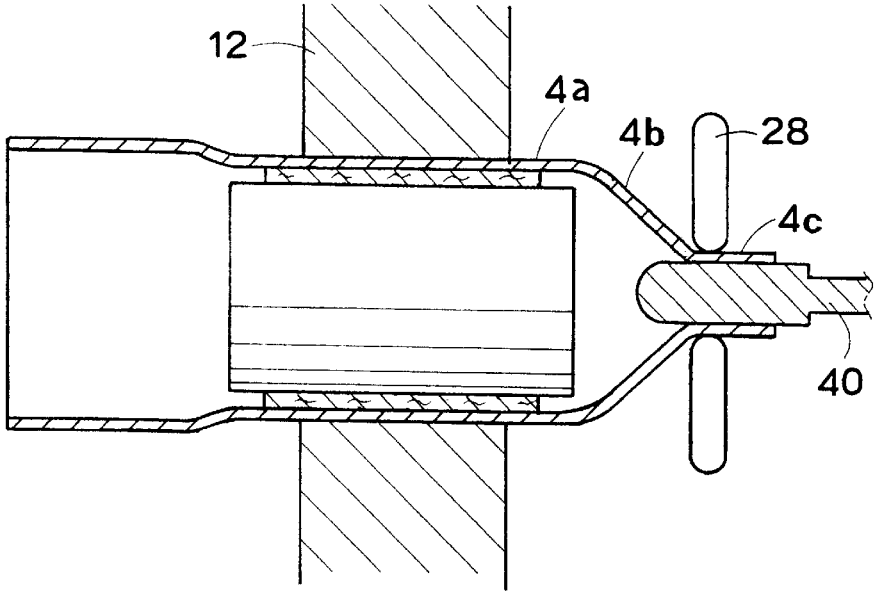
FIG. 10 is a side view sectioned in part of a catalytic converter, with one end potion of the cylindrical housing applied with a necking process by means of spinning rollers, in a further embodiment of a method of producing a catalytic converter according to the present invention.

At the outset, the shock absorbent mat (MT) is rolled around the catalyst substrate (CS) as shown in FIG. 1, and fixed by the inflammable tape if necessary. Then, these are inserted into the cylindrical workpiece 4. Next, as shown in FIG. 9, one end portion of the cylindrical workpiece 4 is clamped by a clamp device 120, which is provided with a stepped portion 121 to block the axial movement of the cylindrical workpiece 4. And, the other one end portion of the cylindrical workpiece 4 is pressed toward the clamp device 120 by a pressing device 122, which is provided with a pressing member formed in a stepped columnar shape. That is, the pressing device 122 is formed with a stepped portion 123, and a columnar portion 124 which is received in the cylindrical workpiece 4, so that the axial movement of the cylindrical workpiece 4 is blocked by the stepped portion 123. Accordingly, opposite ends of the cylindrical workpiece 4 are securely fixed not to be rotated, and not to be moved axially, by means of the clamp device 120 and the pressing device 122. The clamp device 120 may be of collet type, and instead of the pressing device 122, a clamp device of collet type may be used.

Then, the spinning process is made to a portion of the cylindrical workpiece 4 covering the shock absorbent mat (MT), by means of a plurality of spinning rollers 28, which are revolved about the cylindrical workpiece 4 along a common circular locus, in the same fashion as the embodiments as described before. That is, a plurality of spinning rollers, which are positioned around the outer periphery of the cylindrical workpiece 4, with an equal distance spaced between the neighboring rollers, are pressed onto the outer surface of the cylindrical workpiece 4 and revolved about the central axis thereof, and moved along the axis (to the right in FIG. 9), with a revolutionary locus reduced gradually, to achieve the spinning process. Consequently, the shock absorbent mat (MT) is reduced in diameter together with the cylindrical workpiece 4, and the reduced diameter portion 4*a* is formed on a body of the cylindrical workpiece 4, so that the catalyst substrate (CS) is properly held in the reduced diameter portion 4*a*. When the cylindrical workpiece 4 is formed as shown in FIG. 9, the spinning rollers 28 are placed between the clamp device 120 and the pressing device 122, so that the support members 27 or the like as shown in FIG. 2 have to be changed. In this case, however, if the left portion of the apparatus as shown in FIG. 2 is constructed to be changeable, or two specific apparatuses are provided and placed in parallel with each other, a consecutive process can be made.

Figure 11:
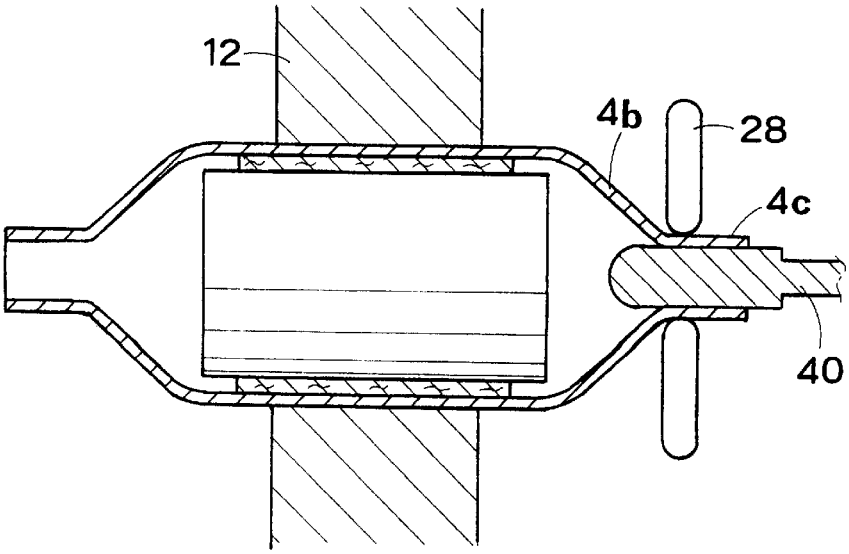
FIG. 11 is a side view sectioned in part of a catalytic converter, with the other one end potion of the cylindrical housing applied with a necking process by means of spinning rollers, in a further embodiment of a method of producing a catalytic converter according to the present invention.

Next, after the pressing device 122 is retracted, the clamp device 120 is released from holding the cylindrical workpiece 4, and the cylindrical workpiece 4 is picked up by a robot hand (not shown). Then, the reduced diameter portion 4*a* of the cylindrical workpiece 4 is securely fixed not to be rotated and not to be moved axially by means of the clamp device 12 as shown in FIG. 2. And, one end portion of the cylindrical workpiece 4 is gradually reduced in diameter by the spinning rollers 28 to provide the tapered portion 4*b*, and the necking process is made with the mandrel 40 inserted into the one end portion of the cylindrical workpiece 4 to provide the bottle neck portion 4*c*. Further, the cylindrical workpiece 4 formed as described above is reversed by 180 degree, and positioned as shown in FIG. 11, so that the necking process is made by means of the spinning rollers 28, with respect to the other one end portion of the cylindrical workpiece 4, as well. The reversing operation of the cylindrical workpiece 4 is performed in the same fashion as described before, so that its explanation is omitted. Thereafter, the other one end portion of the cylindrical workpiece 4 is claimed by the clamp device 12 in FIG. 2, and the unfinished portion of the cylindrical workpiece 4 is formed by the spinning rollers 28 to provide the tapered portion 4*b* and the bottle neck portion 4*c*.

Figure 12:
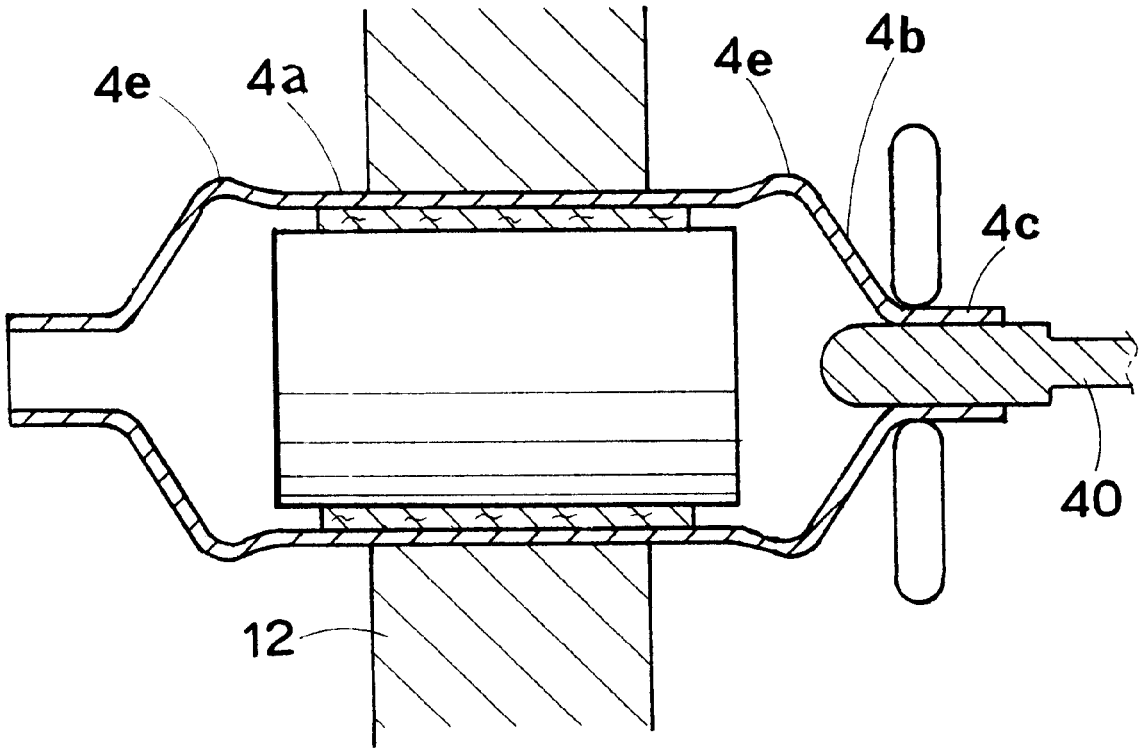
FIG. 12 is a side view sectioned in part of a catalytic converter, with one end potion of the cylindrical housing applied with a necking process by means of spinning rollers, in yet further embodiment of a method of producing a catalytic converter according to the present invention.

As shown in FIG. 12, after the step as shown in FIG. 9, i.e., after the reduced diameter portion 4*a* was formed on a body of the cylindrical workpiece 4, the necking process may be made in such a manner that the opposite end portions of the cylindrical workpiece 4 are formed to provide the tapered portion 4*b* and the bottle neck portion 4*c*, with stepped portions 4*e* formed between the reduced diameter portion 4*a* and the opposite end portions of the cylindrical workpiece 4.

It should be apparent to one skilled in the art that the above-described embodiments are merely illustrative of but a few of the many possible specific embodiments of the present invention. Numerous and various other arrangements can be readily devised by those skilled in the art without departing from the spirit and scope of the invention as defined in the following claims.

What is claimed is:

1. A method of producing a catalytic converter, comprising:

providing a shock absorbent member wrapped around an outer periphery of a catalyst substrate;

inserting the catalyst substrate and the shock absorbent member into a cylindrical workpiece;

fixing the cylindrical workpiece to prevent the cylindrical workpiece from being rotated about a longitudinal axis thereof;

spinning at least a portion of the cylindrical workpiece covering at least a portion of the shock absorbent member, by means of a plurality of spinning rollers, which are evenly positioned around the outer periphery of the cylindrical workpiece, and which are revolved about the axis of the cylindrical workpiece along a common circular locus, and moved in a radial direction of the cylindrical workpiece; and moving the plurality of spinning rollers in an axial direction of the cylindrical member to uniformly compress the shock absorbent material along a longitudinal direction of the shock absorbent material and to simultaneously uniformly reduce a diameter of the cylindrical workpiece around its circumference along at least a part of the shock absorbent material, and thereby hold the catalyst substrate in the cylindrical workpiece.

2. The method of claim 1, further comprising:

measuring an outer diameter of the catalyst substrate and an inner diameter of the cylindrical workpiece;

calculating a target amount of the shock absorbent member to be reduced on the basis of the measured diameters; and moving the spinning rollers in the radial direction of the cylindrical workpiece by the target amount to be reduced.

3. The method of claim 1, wherein the spinning process is made by three spinning rollers positioned with an equal distance spaced between neighboring rollers along the common circular locus.

4. The method of claim 1, further comprising:

reducing the diameter of the portion of the cylindrical workpiece covering the portion of the shock absorbent member consecutively along the axis of the cylindrical workpiece by the spinning rollers moved in the radial direction and the axial direction of the cylindrical workpiece, and simultaneously applying a necking process to at least one end portion of the cylindrical workpiece by the spinning rollers moved in the radial direction and the axial direction of the cylindrical workpiece, to form a neck portion of the cylindrical workpiece.

5. The method of claim 4, wherein the necking process is made by the spinning rollers, with a longitudinal axis of the one end portion of the cylindrical workpiece positioned in a predetermined relationship with a longitudinal axis of the portion of the cylindrical workpiece covering the portion of the shock absorbent member.

6. The method of claim 5, wherein the necking process is made by the spinning rollers, with a mandrel placed in the one end portion of the cylindrical workpiece, the mandrel having a longitudinal axis positioned in a predetermined relationship with the longitudinal axis of the portion of the cylindrical workpiece covering the portion of the shock absorbent member.

7. The method of claim 1, wherein the spinning process is applied to the portion of the cylindrical workpiece covering the portion of the shock absorbent member, with opposite ends of the cylindrical workpiece securely fixed, to reduce the cylindrical workpiece and the shock absorbent member in diameter consecutively along the axis of the cylindrical workpiece, and hold the catalyst substrate in the cylindrical workpiece.

8. The method of claim 7, wherein one end of the cylindrical workpiece is clamped, and the other one end of the cylindrical workpiece is pressed toward the clamped one end of the cylindrical workpiece, to prevent the cylindrical workpiece from being rotated about the longitudinal axis thereof.

9. The method of claim 7, further comprising:

measuring an outer diameter of the catalyst substrate and an inner diameter of the cylindrical workpiece;

calculating a target amount of the shock absorbent member to be reduced on the basis of the measured diameters; and moving the spinning rollers in the radial direction of the cylindrical workpiece by the target amount to be reduced consecutively along the axis of the cylindrical workpiece.

10. The method of claim 7, wherein the spinning process is made by three spinning rollers positioned with an equal distance spaced between neighboring rollers along the common circular locus.

11. The method of claim 7, further comprising:

reducing the diameter of the portion of the cylindrical workpiece covering the portion of the shock absorbent member by the spinning rollers;

securely holding the portion of the cylindrical workpiece covering the portion of the shock absorbent member; and applying a necking process to at least one end portion of the cylindrical workpiece by the spinning rollers moved in the radial direction and the axial direction of the cylindrical workpiece, to form a neck portion of the cylindrical workpiece.

12. The method of claim 11, wherein the necking process is made by the spinning rollers, with a longitudinal axis of the one end portion of the cylindrical workpiece positioned in a predetermined relationship with a longitudinal axis of the portion of the cylindrical workpiece covering the portion of the shock absorbent member.

13. The method of claim 12, wherein the necking process is made by the spinning rollers, with a mandrel placed in the one end portion of the cylindrical workpiece, the mandrel having a longitudinal axis positioned in a predetermined relationship with the longitudinal axis of the portion of the cylindrical workpiece covering the portion of the shock absorbent member.

* * * * *